US009540862B2

(12) United States Patent
Takada

(10) Patent No.: US 9,540,862 B2
(45) Date of Patent: Jan. 10, 2017

(54) INNER GLASS SKIN STRUCTURE FOR DOUBLE GLASS SKIN

(71) Applicant: Device Co., Ltd., Mito-shi, Ibaraki (JP)

(72) Inventor: Yoshimichi Takada, Mito (JP)

(73) Assignee: Device Co., Ltd., Mito-shi (JP)

( * ) Notice: Subject to any disclaimer, the term of this patent is extended or adjusted under 35 U.S.C. 154(b) by 0 days.

(21) Appl. No.: 14/894,006

(22) PCT Filed: Jul. 17, 2014

(86) PCT No.: PCT/JP2014/069095
§ 371 (c)(1),
(2) Date: Nov. 25, 2015

(87) PCT Pub. No.: WO2015/075965
PCT Pub. Date: May 28, 2015

(65) Prior Publication Data

US 2016/0130859 A1 May 12, 2016

(30) Foreign Application Priority Data

Nov. 25, 2013 (JP) ..... 2013-243090

(51) Int. Cl.
*E06B 3/66* (2006.01)
*E06B 3/46* (2006.01)

(52) U.S. Cl.
CPC ..... *E06B 3/66* (2013.01); *E06B 3/4609* (2013.01); *E06B 3/469* (2013.01); *E06B 3/4618* (2013.01); *E06B 3/4681* (2013.01)

(58) Field of Classification Search
CPC ..... E06B 3/66; E06B 3/469; E06B 3/4681; E06B 3/4609; E06B 3/4618
See application file for complete search history.

(56) References Cited

U.S. PATENT DOCUMENTS

2002/0139491 A1* 10/2002 Langenbach ..... E06B 9/13 160/270
2007/0151179 A1* 7/2007 Speyer ..... E06B 7/23 52/207

(Continued)

FOREIGN PATENT DOCUMENTS

JP 57192397 U * 12/1982
JP 60-83830 U 6/1985

(Continued)

OTHER PUBLICATIONS

International Search Report (PCT/ISA/210) issued in PCT Application No. PCT/JP2014/069095 dated Aug. 26, 2014 with English-language translation (five (5) pages).

(Continued)

*Primary Examiner* — Rodney Mintz
(74) *Attorney, Agent, or Firm* — Crowell & Moring LLP

(57) ABSTRACT

An inner glass skin structure is configured by a sashless plate glass that overcomes the difference in the coefficients of linear expansion and insufficient rigidity of aluminum and glass having a superior design, in which the four sides of each of the sashless plate glass are covered by an aluminum covering material having narrow width. The inner glass skin structure is configured by a plurality of sashless plate glasses four sides of which are covered with an aluminum covering material, a door roller and a securing foot member respectively fixed on the bottom of each plate glass on the movable side and immovable side of the plate glass of the sliding door formation, and a lower rail member arranged underneath the plate glass and an upper rail member arranged directly above each plate glass. On the top and bottom of the plate glass, the inner face of an end face cover part of the covering material is bonded to an elastic intervening piece that is fixed to the end face of the plate glass; on both the lateral sides of the plate glass, a plurality of coupling strip plates are inserted in (Continued)

a coupling plate retaining section on the inner face of the end face cover part of the covering material in series with a predetermined spacing therebetween; and each coupling strip plate is bonded to an elastic intervening piece that is secured to the end face of the plate glass.

3 Claims, 8 Drawing Sheets

(56) References Cited

U.S. PATENT DOCUMENTS

| | | | | |
|---|---|---|---|---|
| 2007/0234657 | A1* | 10/2007 | Speyer | E06B 7/23 52/207 |
| 2008/0104892 | A1* | 5/2008 | Cox | E06B 5/12 49/504 |
| 2009/0229201 | A1* | 9/2009 | Hanssen | E06B 3/2605 52/202 |
| 2010/0180504 | A1* | 7/2010 | Kernaghan | E06B 3/4618 49/50 |
| 2011/0197515 | A1* | 8/2011 | Joray | E05D 15/0665 49/425 |
| 2014/0137476 | A1* | 5/2014 | Kim | E06B 3/4609 49/305 |
| 2015/0240552 | A1* | 8/2015 | Kim | E05D 15/0665 49/411 |

FOREIGN PATENT DOCUMENTS

| | | | | |
|---|---|---|---|---|
| JP | 63069286 | U | * | 5/1988 |
| JP | 8-170471 | A | | 7/1996 |
| JP | 9-13813 | A | | 1/1997 |
| JP | 9-228748 | A | | 9/1997 |
| JP | 11030074 | A | * | 2/1999 |
| JP | 2000303601 | A | * | 10/2000 |
| JP | 2002-206376 | A | | 7/2002 |
| JP | 2003-120136 | A | | 4/2003 |
| JP | 2010-144475 | A | | 7/2010 |
| JP | 2011-241114 | A | | 12/2011 |
| JP | 2013199768 | A | * | 10/2013 |

OTHER PUBLICATIONS

Japanese-language Written Opinion issued in PCT Application No. PCT/JP2014/069095 dated Aug. 26, 2014 (three (3) pages).

International Preliminary Report on Patentability (PCT/IB/338 & PCT/IB/373) issued in PCT Application No. PCT/JP2014/069095, including English translation of Written Opinion (PCT/IB/326 & PCT/ISA/237) dated Jun. 9, 2016 (ten (10) pages).

* cited by examiner

FIG. 2C
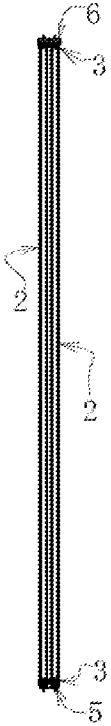
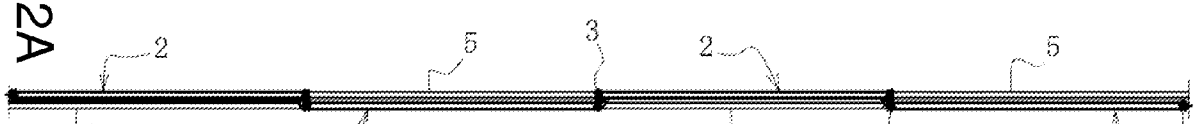
FIG. 2A
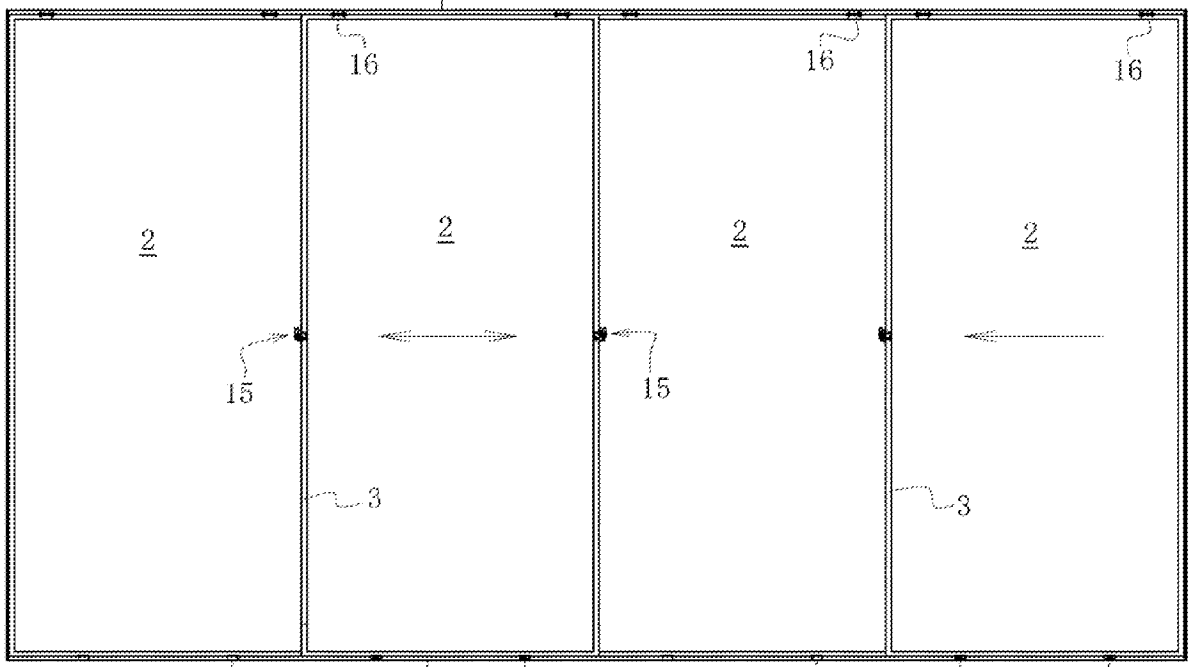
FIG. 2B

INNER GLASS SKIN STRUCTURE FOR DOUBLE GLASS SKIN

TECHNICAL FIELD

The present invention relates to an inner glass skin structure for double glass skin that are installed in buildings for shops of selling a variety of products, restaurants, offices, etc.

BACKGROUND ART

In an attempt at reducing a window surface thermal load caused by sunlight in cooling a room, or at improving the room heating efficiency by heat recovery of air warmed by sunlight; or, to let a window exert its function as an insulated window and a radiation window; there are ideas of configuring openings such as windows with a double-glazed glass having necessary components. Patent literatures 1 and 2 are propositions for this kind of ideas.

Patent literature 3 describes an art as follows: An inner sash that works as an inner glass wall is installed in the indoor side of an existing mullion provided inside the existing glass curtain wall for supporting it. Thereby, the art allows a double glass skin being formed by a retrofit installation work accessing only from the indoor side to improve the room-cooling efficiency.

Therefore, the invention described in Patent literature 3 is able to form a double skin glass by arranging an inner sash inside an existing glass curtain wall by a retrofit installation. The invention however uses an inner sash (literally a frame). Therefore a plate glass without supporting frame cannot be applicable. A large sized plate glass to be used for a big opening may be reinforced by a frame against insufficiencies of its rigidity, but such frame itself may cause a problem of unsightliness in a viewpoint of design.

LITERATURE OF RELATED ART

Patent Literatures

Patent Literature 1:
Japanese Unexamined Utility Model Application Publication No. 1985-83830

Patent Literature 2:
Japanese Unexamined Patent Application Publication No. 2002-206376

Patent Literature 3:
Japanese Unexamined Patent Application Publication No. 2010-144475

SUMMARY OF THE INVENTION

Problems to be Solved by the Invention

An object of the present invention is to provide an inner glass skin structure for double glass skin that is capable of overcoming the difference in the coefficients of linear expansion for an aluminum covering material and a plate glass used in an inner glass skin structure attributable to temperature variation and insufficient rigidity. A solution to the problem in this object is an inner glass skin structure for double glass skin that configures a double glass skin inside a glass curtain wall in combination with the glass curtain wall, wherein the inner glass skin structure is comprised of a sashless plate glass (including double-grazed glass) of good design, the edge portion of which glass is adhesively covered merely with a covering material of aluminum having a narrow width.

Means for Solving the Problem

The first aspect of the present invention is an inner glass skin structure for double glass skin that is to be arranged inside a glass curtain wall with a predetermined spacing therefrom using the glass curtain wall as an outer glass, comprising:

a plurality of plate glasses arrayed in a sliding door formation to be placed inside the outer glass with a predetermined spacing therefrom facing against the outer glass, wherein each edge of four sides of the sashless plate glass are covered with an aluminum covering material;

a door roller fixed on the bottom of each plate glass on the indoor side or the outdoor side or both the sides among the plurality of plate glasses in the sliding door formation intervening the aluminum covering material therebetween, wherein the indoor side is a place opposite of the glass curtain wall with respect to the sliding door formation and the outdoor side is a place on the glass curtain wall side with respect to the sliding door formation;

a securing foot member fixed on the bottom of the plate glass, intervening the aluminum covering material therebetween, to which the door roller is not fixed;

a lower rail member arranged on the floor underneath the plurality of plate glasses and an upper rail member arranged on the ceiling directly above the plurality of plate glasses configuring a pair with the lower rail member, wherein the lower rail member supports movably the bottom of the plate glass for the inner glass intervening the door roller or supports fixedly the bottom of the plate glass for the inner glass intervening the securing foot member therebetween, and the upper rail member supports the plate glass at its top movably or immovably, wherein the aluminum covering material having an approximate U-shape in cross-section comprises an end face cover part that covers the end face of the edge of each plate glass, an inner face cover part that covers the indoor-side-facing surface on the periphery of the edge of the plate glass, and an outer face cover part that covers the outdoor-side-facing surface on the periphery of the edge of the plate glass;

a covering material for covering the top and bottom of the plate glass is fixed on the edge of the plate glass through a bonding of the inside face of the end face cover part to an elastic intervening piece secured on the end face of the plate glass;

the covering material on the portion that covers both the lateral sides of the plate glass has a coupling plate retaining section formed inside the end face cover part thereof, wherein the coupling plate retaining section accommodates a plurality of coupling strip plates arranged therein along the inner face thereof in a series formation with a predetermined regular mutual spacing retaining only both the lateral sides of each coupling strip plate to permit free movement thereof along the longitudinal direction of the end face cover part; and the plurality of coupling strip plates arranged in the coupling plate retaining section are fixed on the end face of the plate glass by bonding the plurality of coupling strip plates to the elastic intervening piece secured on the end face of the plate glass and thereby the coupling strip plates in the coupling plate retaining section are secured on the end face of the plate glass.

The second aspect of the present invention is an inner glass skin structure for double glass skin according to the first aspect of the present invention further comprising a reinforcing strip plate, wherein the covering material on the portion that covers both the lateral sides of the plate glass has a reinforcing strip plate insertion slot that is formed along the longitudinal direction of the end face cover part on the outside thereof, and the reinforcing strip plate is inserted therein.

The third aspect of the present invention is an inner glass skin structure for double glass skin according to the first or the second aspect of the present invention further comprising an elastic member, wherein the elastic member is provided on such a portion of each lateral side of each of the plate glasses as bumps against the door-hitting portion, wherein such plate glasses are the ones positioned on both ends of the sliding door formation as the inner glass skin configured by the plurality of the same, to absorb a certain range of movement of each plate glass that tends to move toward the door-hitting portion along the direction guided by the upper or lower rail member if earthquake occurs.

Advantageous Effect of the Invention

The inner glass skin structure for double glass skin by the first aspect of the present invention easily gains advantageous effect, which a double glass skin structure brings about. The invention configures easily a double glass skin by installing simply an inner glass comprising a sashless plate glass of good design covered with a narrow-width aluminum covering material at its edge inside an existing or a new glass curtain wall (an outer glass). With this, the present invention brings about an effect of the double glass skin structure, which is reduction of a window surface thermal load caused by sunlight in cooling a room or improvement of the room heating efficiency by heat recovery of air warmed by sunlight.

The inner glass skin structure for double glass skin by the first aspect of the present invention is able to enhance the design by using a sashless style by covering the edge of the plate glass with the narrow-width aluminum covering material as stated above.

The covering material on the top and bottom sides of the plate glass is, as stated above, attached thereon through a bonding of the inside face of the end face cover part to the elastic intervening piece secured on the end face of the plate glass. The covering material on both the lateral sides of the plate glass is attached thereon, as stated above, through the bonding of the plurality of the coupling strip plates to the elastic intervening piece secured on the end face of the plate glass, wherein the plurality of coupling strip plates are inserted in a series formation with a predetermined mutual spacing in the coupling plate retaining section formed on the inside face of the end face cover part.

Aluminum forming the covering material and glass forming the plate glass are significantly different in their coefficients of linear expansion attributable to the temperature variation. The expansion and contraction of the top and bottom sides of the plate glass occur toward both directions and the lateral size of the top and bottom of the plate glass is smaller than the vertical size thereof. Therefore, the size difference between them resulted from temperature variation can be absorbed when the elastic intervening piece has an ample thickness and elasticity. This maintains assured attaching condition between the covering material and the plate glass.

On both the lateral sides of the plate glass, the plurality of coupling strip plates retained by the coupling plate retaining section are bonded to the elastic intervening piece secured on the end face of the plate glass, and each of the coupling strip plates is designed short in length, therefore the difference in the expansion lengths between the coupling strip plate and the glass of the plate glass is comparatively small. Thus, as long as the elastic intervening piece placed between the coupling strip plate and the plate glass has an ample thickness and elasticity, the difference in the expansion lengths can be easily absorbed. Since the junction between the coupling strip plate and the end face cover part of the covering material is formed in such a manner as permits a free longitudinal movement within the coupling plate retaining section, the difference can be absorbed with sufficient allowance even if the coefficient of linear expansion attributable to temperature variation exists between them.

Therefore, the inner glass skin structure for double glass skin by the first aspect of the present invention permits employing a bonding-joint, even if a large difference in the coefficient of linear expansion attributable to temperature variation exists between glass of the plate glass and aluminum of the covering material. This structure also permits performing the covering each edge of four sides of the plate glass with a narrow-width covering material in an assured manner. Thus, the plate glass can enhance its design as a sashless style.

In the inner glass skin structure for double glass skin by the second aspect of the present invention, the rigidity of the plate glass is ensured not by a frame, but ensured fundamentally in itself by giving a properly designed thickness or composing with a combination of plural sheets of glass. Further, a high rigidity can be ensured easily by the reinforcing strip plate inserted in the reinforcing plate insertion slot formed on the outside of the end face cover part of the covering material.

The inner glass skin structure for double glass skin by the third aspect of the present invention provides an elastic member on such a portion of each lateral side of each of the plate glasses as bumps against the door-hitting portion, wherein such plate glasses are the ones positioned on both ends of the sliding door formation as the inner glass skin configured by the plurality of the plate glasses. If, for example, earthquake occurs, the plate glass tends to move along the direction guided by the upper and lower rail member, and one of or both of the plate glasses positioned on the both ends of the plurality of plate glasses that configure the sliding door formation bumps against the door-hitting portion. In this event, the elastic member absorbs a certain range of such movement of the plate glass.

BRIEF DESCRIPTION OF THE DRAWINGS

FIG. 2 This figure is an explanatory diagram.

FIG. 2A An explanatory schematic plan view of the inner skin glass structure for double glass skin in an embodiment.

FIG. 2B An explanatory schematic front view.

FIG. 2C An explanatory schematic right-side view.

FIG. 5 This is an explanatory diagram.

FIG. 7 This is an explanatory cross-sectional view of the plate glass.

MODES OF IMPLEMENTING THE INVENTION

The following describes modes of implementing the invention based on an embodiment in detail referring to drawings.

Figure 1:
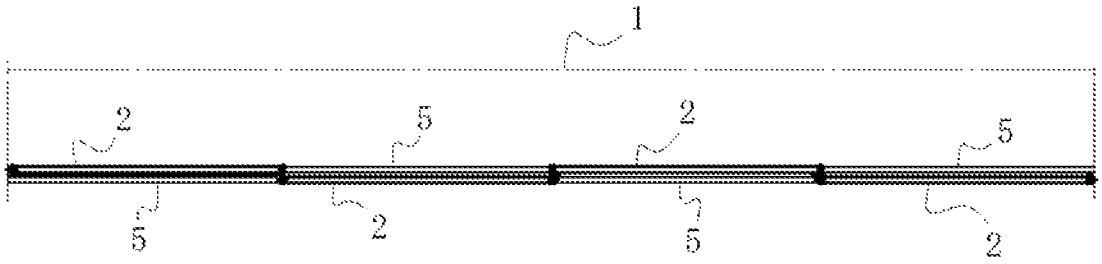
FIG. 1 This figure is a conceptual diagram of the inner glass skin structure for double glass skin in an embodiment.

The inner glass skin structure for double glass skin in this embodiment is basically an inner glass skin structure for double glass skin that is to be placed inside a glass curtain wall with a predetermined spacing therefrom using the glass curtain wall as an outer glass 1 as shown in FIG. 1.

The inner glass skin structure for double glass skin comprises:

a plurality of plate glasses 2 configuring a sliding door formation arranged inside the outer glass 1 with predetermined spacing facing against the outer glass 1, wherein each edge of four sides of the sashless plate glass 2 are covered with an aluminum covering material 3 as shown in FIGS. 2, 3, 6, and 7;

a door roller 4 fixed on the bottom of each of the plate glasses 2 on the indoor side among the plurality of plate glasses 2 that configure the sliding door formation intervening the aluminum covering material 3 therebetween;

a securing foot member 14 fixed on the bottom of each of the plate glasses 2 on the outdoor side among the plurality of plate glasses 2 that configure the sliding door formation intervening the aluminum covering material 3 therebetween;

a lower rail member 5 arranged on the floor underneath the plurality of plate glasses 2 on the indoor and outdoor sides as stated above; and an upper rail member 6 arranged on the ceiling directly above the plurality of plate glasses 2 on the indoor and outdoor sides configuring a pair with the lower rail member 5, wherein the upper rail member 6 holds movably or immovably the top of the plurality of plate glasses 2 on the indoor and outdoor sides.

The outer glass 1 may be existing ones or new ones. In many cases, assumed examples are to install this structure on the openings of buildings for shops of providing various products (cars, etc.) or services (banking, etc.).

This embodiment employs a double-glazed glass as the plate glass 2 as shown in FIGS. 2, 3, 6, and 7. The employed double-glazed glass has a construction in which two sheets of component glass 2*a* of vertically long rectangle are disposed in a face-to-face formation with a predetermined spacing therebetween and are bonded each other with a bonding material 2*b* placed therebetween along the four sides thereof with the spacing between them maintained; and a desiccant 2*c* is put inside the bonding material 2*b* placed vertically and horizontally. As the plate glass 2, any other glass such as a single plate glass or another double-glazed glass having different structure may be used at discretion. However, it is anyway necessary to ensure the rigidity and to give the glass a properly designed thickness.

Figure 3:
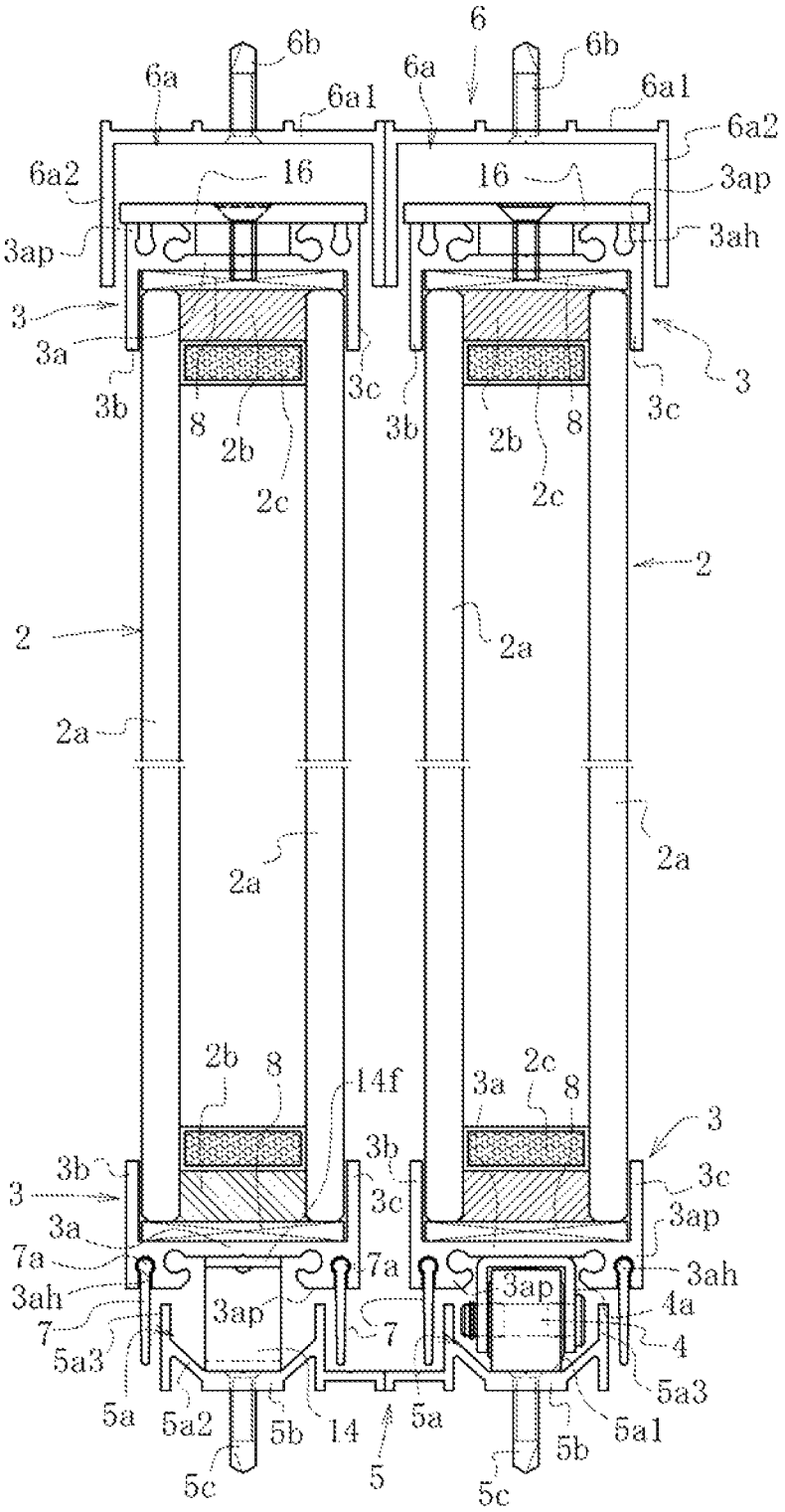
FIG. 3 This is an explanatory partial sectional view sectioned along the line A-A in FIG. 2B.
Figure 4:
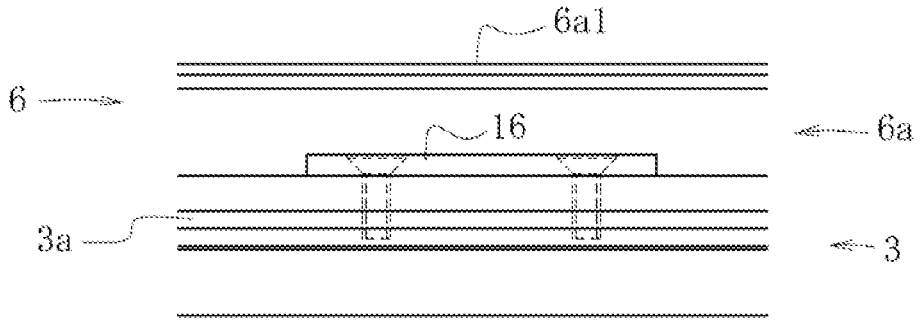
FIG. 4 This is an explanatory partial side view of the part around the top end according to FIG. 2B with the side-limit plate and the shield plate omitted.
Figure 6:
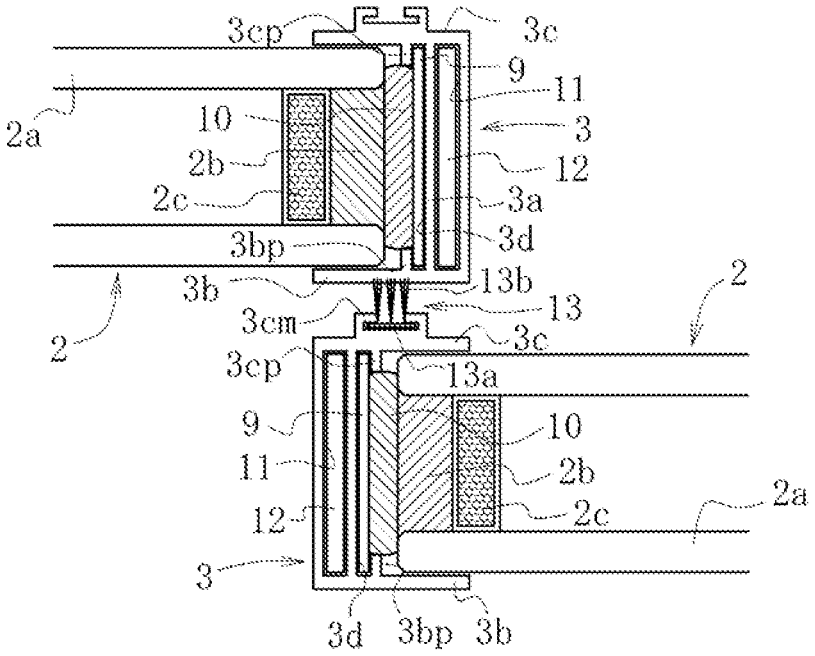
FIG. 6 This is an explanatory cross-sectional view of the part around the junction between the adjacent indoor side and the outdoor side plate glasses.
Figure 7A:
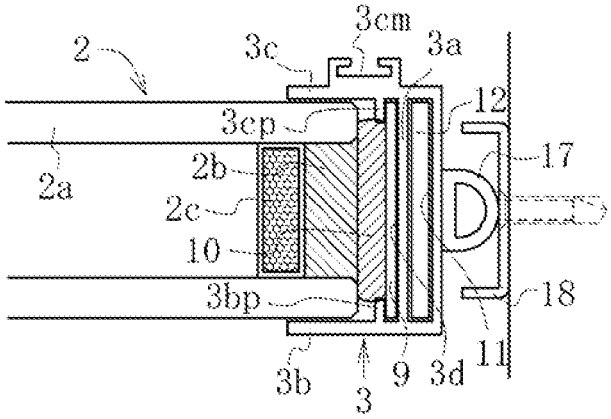
FIG. 7A An explanatory cross-sectional plan view of the lateral side of the outer edge-side of the plate glass on one end, and of the portion around the door roller.
Figure 7B:
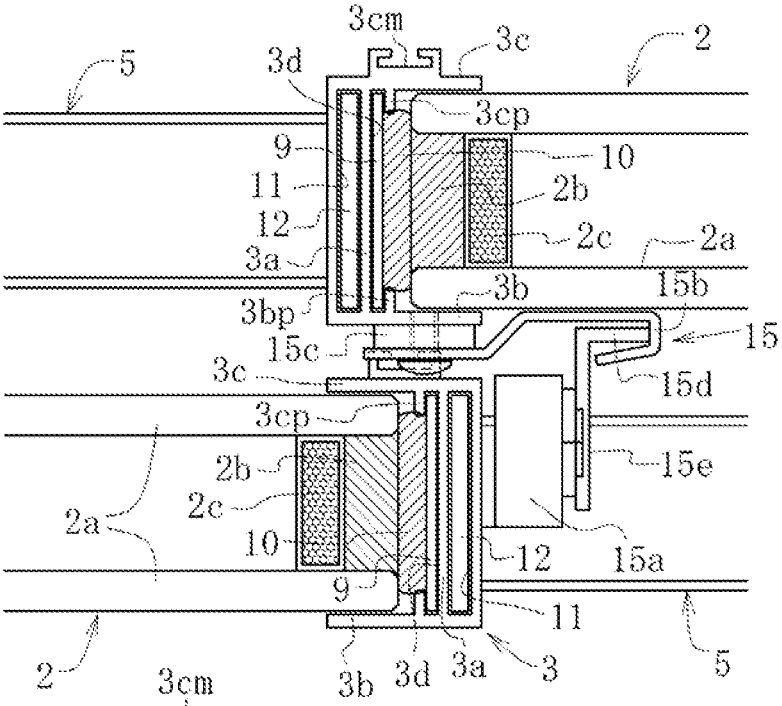
FIG. 7B An explanatory cross-sectional plan view around the junction between the adjacent indoor side and the outdoor side plate glass.
Figure 7C:
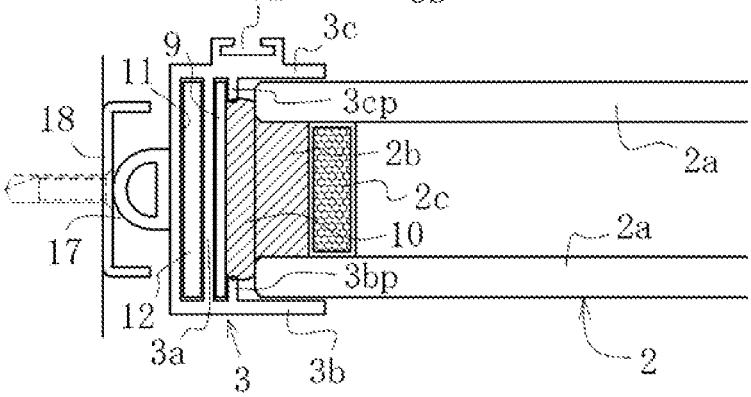
FIG. 7C An explanatory cross-sectional plan view of the lateral side of the outer edge-side of the plate glass on the other end, and of the portion around the door-hitting portion.
Figure 8:
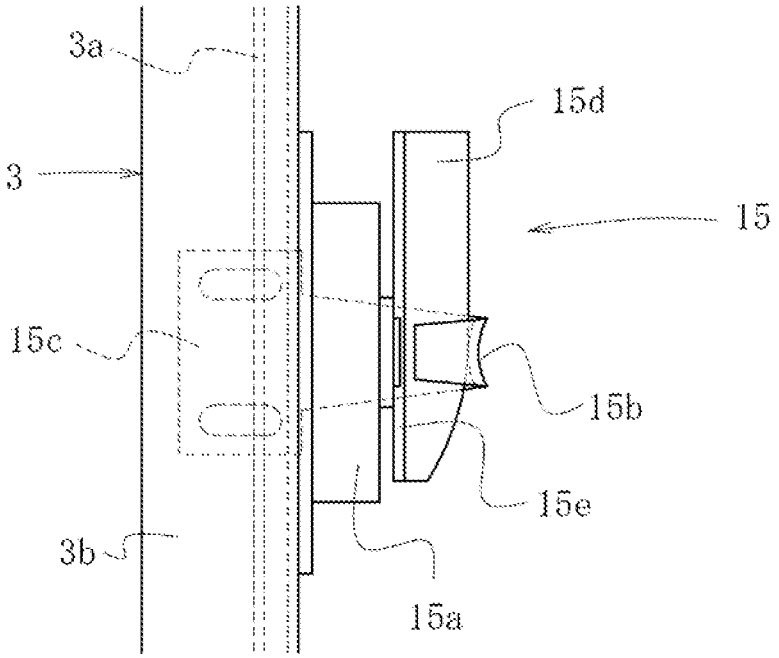
FIG. 8 This is an explanatory side view around the junction between the adjacent indoor side and the outdoor side plate glass.

The covering material 3 is an aluminum member and has an approximately U-shaped cross-sectional configuration. As shown in FIGS. 3, 6, and 7, the basic construction comprises an end face cover part 3*a* that covers the end face of the edge of each plate glass 2, an inner face cover part 3*b* that covers the indoor-side-facing surface on the periphery of the edge of the plate glass, and an outer face cover part 3*c* that covers the outdoor-side-facing surface on the periphery of the edge of the plate glass. The inner face cover part 3*b* covers the indoor side face of the edge portion of the plate glass 2 and the outer face cover part 3*c* covers the outdoor side of the edge portion of the plate glass 2.

The covering material 3 on the bottom of the plate glass 2 has a shield plate 7 of synthetic rubber. As shown in FIG. 3, shield plate 7 are provided respectively at positions slightly inward from each of the inner face cover part 3*b* and the outer face cover part 3*c*, which are located at the bottom face of the end face cover part 3*a*. Each shield plate 7 is fitted in a hang down manner from the respective cover part. The base of the shield plate 7 is shaped into a bulge 7*a* that is circular in cross-section as shown in FIG. 3. Engaging slots 3*ah* are grooved respectively on positions slightly inward from each of the inner cover part 3*b* and the outer face cover part 3*c*, which are located on the bottom of the end face cover part 3*a* of the covering material 3. The bulge 7*a* engages with the engaging slot 3*ah*, so that the shield plate 7 is fitted in a hang down manner therefrom. Engaging slots 3*ah* are grooved respectively in each of projecting parts 3*ap* that are bulgingly formed at positions slightly inward from each of the inner face cover part 3*b* and the outer face cover part 3*c*, which are located on the bottom face side of the end face cover part 3*a*.

The covering material 3 to be fitted on the top of the plate glass 2 does not have the shield plate 7 as shown in FIG. 3. This embodiment however does not use such specific covering material for the top end use but uses the same covering material as the one for the bottom end. Therefore, the covering material 3 used on the top in this embodiment has the projecting part 3*ap* and the engaging slot 3*ah*, but there arises no problem in the function and external appearance.

The inside face of the end face cover part 3*a* of the covering material 3 to be fitted on both the top and bottom of the plate glass 2 is fixed on each of the edges of the top and bottom of the plate glass 2 through a bonding to an elastic intervening piece 8 secured on the end face of the plate glass 2 as shown in FIG. 3. In this embodiment, the elastic intervening piece 8 is a synthetic rubber product having the same width as the thickness of the plate glass 2, and is bonded to each end face of two sheets of the component glass 2*a* that form the end face of the plate glass 2 and to the bonding material 2*b* placed therebetween; thus the whole face of the top and bottom of the plate glass 2 is covered therewith. The inside face of the end face cover part 3*a* of the covering material 3 is bonded to the elastic intervening piece 8 bonded to the whole end face of the plate glass 2.

The covering material 3 to be fitted on both the lateral sides of the plate glass 2 has a coupling plate retaining section 3*d* in the inside of the end face cover part 3*a* as shown in FIGS. 6 and 7. The coupling plate retaining section 3*d* is formed by the inside face of the end cover part 3*a* and protrusions 3*bp* and 3*cp*. The protrusions 3*bp* and 3*cp* protrude from the inside surfaces of the inner face cover part 3*b* and the outer face cover part 3*c* respectively, in parallel to the inner surface of the end cover part 3*a*. The position of each of the protrusions 3*bp* and 3*cp* is a place such that an interstice having a space slightly larger than the thickness of a coupling strip plate 9, this will be mentioned later, is created between the end face cover part 3*a*. In the coupling plate retaining section 3*d*, a plurality of coupling strip plates 9 are inserted in series with a predetermined spacing.

On the other hand, the elastic intervening piece 10 is bonded on the end face of the glass plate 2 that faces the coupling strip plate 9 inserted in the coupling plate retaining section 3*d* as shown in FIGS. 6 and 7, and the coupling strip plate 9 is jointed to the elastic intervening piece 10 with an adhesive.

In this embodiment, the elastic intervening piece 10 is a strip-shaped elastic member of synthetic rubber, and the width thereof is slightly narrower than the distance between the top ends of the protrusions 3*bp* and 3*cp* of the coupling plate retaining section 3*d* as shown in FIGS. 6 and 7. The elastic intervening piece 10 bonds, as shown in those figures, to a part of each of inner portions of the edge of two component glasses 2*a* that forms the edge of the plate glass 2 and to the outer face of the bonding material 2*b* placed between the component glasses 2*a*. The elastic intervening piece 10 in this configuration is longitudinally arranged over the whole surface of the plate glass 2. The inner faces of the plurality of the coupling strip plates 9 are bonded to the outer face of the elastic intervening piece 10. This embodiment uses stainless steel strip for the coupling strip plate 9 stated above.

The covering material 3 for the portion to be fitted on both the lateral sides of the plate glass 2 has a reinforcing strip plate insertion slot 11 on the outer side of the end face cover part 3*a* as shown in FIGS. 6 and 7. The reinforcing strip plate insertion slot 11 is formed along the longitudinal direction of the cover part 3*a* in parallel thereto, and a reinforcing strip plate 12 is inserted therein. This embodiment uses stainless steel strip for the reinforcing strip plate 12 stated above.

The covering material 3 for the portion to be fitted on both the lateral sides of the plate glass 2 on the indoor side has an engaging groove 3*cm* on the outer face cover part 3*c* as shown in FIG. 6. The center portion of the width of the engaging groove 3*cm* opens outward that accommodates a shield brush 13 inserted therein. The shield brush 13 is comprised of a strip bedplate 13*a* and a mohair 13*b*, wherein the mohair 13*b* is implanted on the strip bedplate 13*a* along the center thereof. The shield brush 13 is inserted in the engaging groove 3*cm* in a manner such that the strip bedplate 13*a* is fitted in the engaging groove 3*cm* with the brush of the mohair 13*b* thereon facing to the outside protruding outward from the groove opening.

In this embodiment, the covering material 3 in a similar configuration as the above is used on both the lateral sides of the plate glass 2 on the outdoor side. Therefore, the outer face cover part 3*c* of the covering material 3 on both the lateral sides of the plate glass 2 on the outdoor side also has the engaging groove 3*cm*; however the shield brush 13 is naturally not fitted.

Figure 5A:
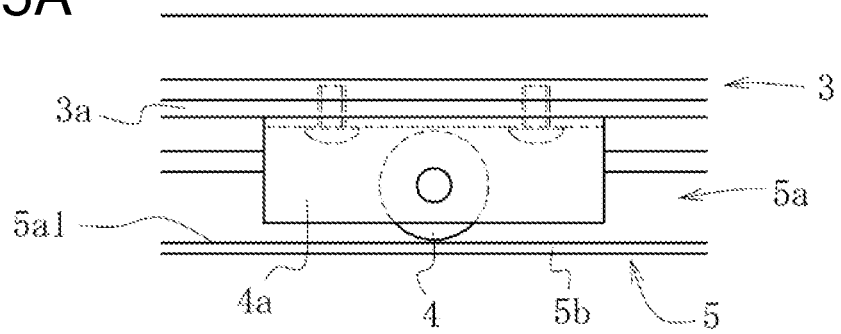
FIG. 5A An explanatory diagram of the part around the door roller on the bottom end according to FIG. 2B with the side-limit plate and the shield plate omitted.
Figure 5B:
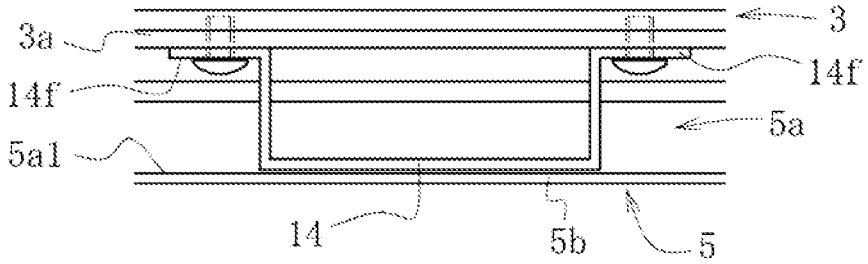
FIG. 5B An explanatory diagram of the part around the securing foot member on the bottom end according to FIG. 2B with the side-limit plate and the shield plate omitted.

The door roller 4 is fitted on the bottom of each plate glass 2 on the indoor side (in a position of inner side) in the sliding door formation as shown in FIGS. 2(*b*), 3, and 5(*a*); and is a member for allowing them moving smoothly on the lower rail member 5. In this embodiment, particularly as shown in FIG. 2(*a*), the door roller 4 is fitted balanced two by two on the bottom of every plate glass 2 on the indoor side. As shown in FIGS. 3 and 5(*a*), each door roller 4 is installed rotatably on a bracket 4*a* of inverted U-shape attached on the outer face (bottom face) of the end face cover part 3*a* of the covering material 3 fitted on the bottom of each plate glass 2. The bracket 4*a* is of course oriented to be parallel to both the faces of the plate glass 2 and the door roller 4 is installed rotatably in that direction. The bracket 4*a* is fitted, by screwing its top face, in the center of the lower surface of the end face cover part 3*a* of the covering material 3 (in the part between the projection parts 3*ap*).

The securing foot member 14 is, as shown in FIGS. 2(*b*), 3, and 5(*b*), fitted on the bottom of each plate glass 2 on the outdoor side (in a position of outer side) as shown in FIGS. 2(*b*), 3, and 5(*a*); and is a member for securing the plate glass 2 fixedly on the lower rail member 5. In this embodiment, particularly as shown in FIG. 2(*a*), the securing foot member 14 is fitted balanced two by two on the bottom of every plate glass 2 on the outdoor side. As shown in FIGS. 3 and 5(*a*), each securing foot member 14 is an approximately U-shaped member attached additionally on the outer face (bottom face) of the end face cover part 3*a* of the covering material 3 fitted on the bottom edge of each plate glass 2. The securing foot member 14 is a member that has a fixing tongue 14*f* extending laterally from its both ends. Both the fixing tongues 14*f* are fitted in the center of the lower surface of the end face cover part 3*a* of the covering material 3 (in the part between the projection parts 3*ap*) with a screw so that the bottom portion of the U-shape abuts on a tread 5*a*1, this will be mentioned later, of the lower rail member 5.

The lower rail member 5 has two of a rail portion 5*a* to make the plurality of plate glasses 2 configure a sliding door formation. As shown in FIG. 3, each of two rail portions 5*a* is configured as follows: The top face of a strip basal portion 5*b* is the tread 5*a*1, on which the door roller 4 rolls and with which the bottom portion of the U-shape of the securing foot member 14 abuts. A slant 5*a*2 extends upward toward outer side from each of both the side-ends of the tread Sal with same slant angle; the upper side of a side-limit plate 5*a*3 extends upward from both the outer-ends of the slant 5*a*2; and the lower side of the side-limit plate 5*a*3 extends downward to the same height as the position of the strip basal portion 5*b*.

In this embodiment, two of the rail portion 5*a* are arranged in parallel to each other to configure one lower rail member 5. However, arranging two separately manufactured rails in parallel each other is not inexpedience.

The lower rail member 5 stated above is fixed on the floor underneath the plate glass 2 arranged inside the outer glass 1 with a predetermined spacing therefrom as shown in FIG. 1. This fixing is performed using a screw 5*c* that is screwed from the top face of the strip basal portion 5*b* into the floor.

The upper rail member 6 is to be installed on the ceiling positionally corresponding to the lower rail member 5 stated above and has two of a rail portion 6*a* to make the plurality of plate glasses 2 configure a sliding door formation as shown in FIG. 3. Each of two rail portions 6*a* is a narrow portion both sides of which are partitioned respectively by side-limit plates 6*a*2 extending downward from the both side-ends of the strip basal portion 6*a*1.

The inside of the side-limit plate 6*a*2 of each rail portion 6*a* has a configuration such that the top of each plate glass 2 is fitted therein as shown in FIG. 3. On the top face of the end face cover part 3*a* of the covering material 3 arranged on the edge portion of the top of each glass plate 2, an abutting plate 16 of synthetic rubber strip having a width slightly larger than that of the covering material 3 is fitted. The both side-edges of the abutting plate 16 are made contact with the side-limit plate 6*a*2 of the rail portion 6*a*. The abutting plate 16 is mounted on the projection part 3*ap* on the top face of the end face cover part 3*a* of the covering material 3, and is screwed on the end face cover part 3*a* with an appropriate longitudinal screwing spacing using a plurality of screws.

The upper rail member 6 is fixed on the ceiling by screwing a screw 6*b* upward from the bottom face of the strip basal portion 6*a*1 as shown in FIG. 3.

In this embodiment, as with the lower rail member 5, two of the rail portion 6*a* are arranged in parallel to each other to configure one upper rail member 6. However, arranging two separately manufactured rails in parallel each other is not inexpedience.

As shown in FIG. 3, the top of the plate glass 2 is fitted in the rail portion 6*a* of the upper rail member 6. When the one on the indoor side among the plurality of plate glasses 2 in the sliding door formation is moved along the upper rail member 6 and the lower ail member 5, each door roller 4 on the bottom thereof rolls along the tread Sal of the lower rail member 5, and the both side-edges of the abutting plate 16 on the top thereof moves along the rail portion 6*a*. While the plate glass 2 is on move, the abutting plate 16 makes contact with any of the side-limit plates 6*a*2 on both sides of the rail portion 6*a* and comes into a sliding state ensuring a smooth movement of the plate glass 2.

The outdoor side one among the plurality of plate glasses 2 is immovable, because the securing foot member 14 is fixed on the bottom end thereof. In this configuration however, the abutting plate 16 on each glass door 2 makes contact with any of the side-limit plates 6*a*2 on both sides of the rail portion 6*a* depending on situation and works to ensure that the position is approximately upright.

The plate glass 2 stated above is arranged in two of the rail portion 5*a* of the lower rail member 5 and two of the rail portion 6*a* of the upper rail member 6 respectively to configure the inner glass skin. For closing this portion, the plate glass 2 is configured, as shown in FIGS. 1 and 2(*a*), to allow locking by a crescent lock 15 as follows: Two of the plate glass 2 are alternately positioned one in the outdoor side (outer side) of two rail portions 5*a* and 6*a* and the other in the indoor side (inner side) of another two rail portions 5*a* and 6*a*. The plate glass 2 on the outdoor side is fixed in position as stated above. In this embodiment, the crescent lock 15 is installed on the side portion of each of the adjoining plate glasses 2 on the outdoor side and the indoor side so that they can be locked mutually in the intended position.

The crescent lock 15 is a commercial product. As shown in FIGS. 7(*b*) and 8, a base 15*a* on the main body is fixed on the outside portion of the end face cover part 3*a* of the covering material 3 fitted on the side face of the plate glass 2 on the indoor side and a mounting base 15*c* of a catch 15*b* is fixed on the inner face cover part 3*b* of the covering material 3 fitted on the corresponding side face of the plate glass 2 on the outdoor side.

A baseplate 15*e* having an engaging crescent 15*d* on its edge portion is rotatably supported on the base 15*a* as shown in FIGS. 7(*b*) and 8. This configuration is for locking each other the adjoining plate glasses 2 each on the indoor side and the outdoor side by turning the engaging crescent 15*d* so that the top end thereof moves toward the outside to be caught in the catch 15*b*. The base 15*a* and the mounting base 15*c* of the catch 15*b* are fixed at a mutual position that permits locking by that configuration. This configuration is a conventional practice.

As shown in FIGS. 7(*a*) and 7(*c*), an elastic cylinder (an elastic member) 17 is provided on such a portion of each lateral side of each of the plate glasses 2 as bumps against the door-hitting portion, wherein such plate glasses 2 are the ones positioned on both ends of the sliding door formation as the inner glass skin configured by the plurality of the same.

As stated above and shown in FIGS. 7(*a*) and 7(*c*), the elastic cylinder 17 in this embodiment is a long elastic member and is fitted outside the end face cover part 3*a* of the covering material 3 fitted on the door-hitting portion of the plate glass 2 in the end place in the sliding door formation, and more particularly, on the outside face of the reinforcing strip plate insertion slot 11. The elastic cylinder 17 is a hollow hog-backed member. In a plan view, its front bulges out to a semi-cylindrical shape and its rear is flat. The flat rear portion thereof is attached on the end face cover part 3*a* over the whole length of the height thereof along the center of the width. Attaching this member is performed by gluing.

On the door-hitting portion that faces the side face of the plate glass 2 in the end place in the sliding door formation, on which side face the elastic cylinder 17 is attached, a shield 18, a U-shaped member in a plan view, is attached as shown in FIGS. 7(*a*) and 7(*c*). The shield 18 has the same length as the elastic cylinder 17 and is arranged over the same height-wise length range as the elastic cylinder 17.

The configuration of the inner glass skin structure for double glass skin in this embodiment is as stated above. The plate glass 2 on the indoor side is configured movable along the lower rail member 5 and the upper rail member 6; the plate glass 2 on the outdoor side is arranged immovable namely fixed state. Naturally, it is practicable to configure the plate glass 2 on the outdoor side also movable by applying the same configuration to its lower part as that of the plate glass 2 on the indoor side.

The configuration of the inner glass skin structure for double glass skin in this embodiment is as stated above. This configures easily a double glass skin by installing simply an inner glass comprising the plate glass 2 of good design, which is covered with the narrow-width aluminum covering material 3 at its edge, inside an existing or a new glass curtain wall (the outer glass 1). With this, the present invention brings about an effect of the double glass skin structure, which is reduction of a window surface thermal load caused by sunlight in cooling a room or improvement of the room heating efficiency by heat recovery of air warmed by sunlight.

The inner glass skin structure for double glass skin in this embodiment uses the plate glass 2 the edge of which is covered with the narrow-width aluminum covering material 3 to allow using the plate glass 2 of good design as stated above.

The covering material 3 to be arranged on the top and bottom of the plate glass 2 is, as stated above, attached thereon through a bonding of the inner face of the end face cover part 3*a* to the elastic intervening piece 8 secured on the end face of top and bottom of the plate glass 2. The covering material 3 to be arranged on both the lateral sides of the plate glass 2 is attached thereon, as stated above, through the bonding of the plurality of the coupling strip plates 9 to the elastic intervening piece 10 secured on the end face of the plate glass 2, wherein the plurality of coupling strip plates 9 are inserted in a series formation with a predetermined spacing in the coupling plate retaining section 3*d* formed on the inner face of the end face cover part 3.

Aluminum forming the covering material 3 and glass forming the plate glass 2 are significantly different in their coefficients of linear expansion attributable to the temperature variation. The lateral size of the top and bottom of the plate glass 2 is smaller than the vertical size thereof and the expansion and contraction of the covering material 3 and the plate glass 2 due to temperature variation occurs toward both sides. Therefore, the length difference due to temperature variation among each corresponding part of the covering material 3 and the plate glass 2 is relatively small. Thus, the difference between them resulted from temperature variation can be absorbed when the elastic intervening piece 8 has an ample thickness and elasticity. This maintains assured attaching or bonding conditions between the covering material 3 and the plate glass 2.

On both the lateral sides of the plate glass 2, the coupling strip plate 9 retained by the coupling plate retaining section 3*d* is bonded to the elastic intervening piece 10 secured on the end face of the plate glass 2, each of the coupling strip plates 9 is designed short in length, and the difference in the expansion lengths between each coupling strip plate 9 and glass of the plate glass 2 is sufficiently small. Therefore, as long as the sandwiched elastic intervening piece 10 has an ample thickness and elasticity with respect to the expansion and contraction, the difference in the expansion lengths can be easily absorbed. Since the junction between the coupling strip plate 9 and the end face cover part 3*a* of the covering material 3 is formed in such a manner as permits a free longitudinal movement in the coupling plate retaining section, the difference can be absorbed with sufficient allowance even if the coefficient of linear expansion attributable to temperature variation exists between them.

Thus, the features of the present invention are as stated above. The inner glass skin structure for double glass skin in this embodiment permits employing a bonding-joint, even if a large difference in the coefficient of linear expansion attributable to temperature variation exists between the glass of the plate glass 2 and the aluminum of the covering material 3. This structure also permits performing the covering each edge of four sides with a narrow-width covering material 3 in an assured manner. Thereby, the invented inner glass skin structure for double glass skin can enhance its design quality.

In addition, in the inner glass skin structure for double glass skin of this embodiment, the rigidity of the plate glass 2 is ensured not by a frame but fundamentally by combining two sheets of plate glass. This is for ensuring the rigidity by the glass itself. Further, a more enhanced high rigidity can be ensured easily by the reinforcing strip plate 12 inserted in the reinforcing plate insertion slot 11 formed on the outside portion of the end face cover part 3*a* of the covering material 3 so that the reinforcing strip plate 12 can be accommodated therein.

Moreover, in the inner glass skin structure for double glass skin of this embodiment, the elastic cylinder 17 is provided on such a portion of each lateral side of each of the plate glasses 2 as bumps against the door-hitting portion, wherein such plate glasses 2 are the ones positioned on both ends of the sliding door formation as the inner glass skin configured by the plurality of the same. If earthquake occurs, each plate glass 2 that configures the inner glass skin moves along the direction guided by the upper rail member 6 and lower rail member 5 and the plate glasses 2 on both ends tend to move toward the corresponding door-hitting portion. In this event, the elastic cylinder 17 can absorb a certain range of such movement of the plate glass 2 accordingly.

In addition, needless to say, unlocking the crescent lock 15 allows the plate glass 2 on the indoor side to move along the lower rail member 5 and the upper rail member 6. This enables cleaning the space between the outer glass 1 and the inner glass or maintaining equipment placed in such space to be performed without inconvenience.

INDUSTRIAL APPLICABILITY

The inner glass skin structure for double glass skin of the present invention can be effectively used in the field of architecture.

DESCRIPTION OF REFERENCE NUMERALS

1 Outer glass
2 Plate glass
2*a* Component glass
2*b* Bonding material
2*c* Desiccant
3 Covering material
3*a* End face cover part
3*ah* Engaging slot
3*ap* Projecting part
3*b* Inner face cover part
3*bp* Protrusion
3*c* Outer face cover part
3*cm* Engaging groove
3*cp* Protrusion
3*d* Coupling plate retaining section
4 Door roller
4*a* Bracket
5 Lower rail member
5*a* Rail portion
5*a*1 Tread
5*a*2 Slant
5*a*3 Side-limit plate
5*b* Strip basal portion
5*c* Screw
6 Upper rail member
6*a* Rail portion
6*a*1 Strip basal portion
6*a*2 Side-limit plate
6*b* Screw
7 Shield plate
7*a* Bulge
8 Elastic intervening piece
9 Coupling strip plate
10 Elastic intervening piece
11 Reinforcing strip plate insertion slot
12 Reinforcing strip plate
13 Shield brush
13*a* Strip bedplate
13*b* Mohair
14 Securing foot member
14*f* Fixing tongue
15 Crescent lock
15*a* Base
15*b* Catch
15*c* Mounting base
15*d* Engaging crescent
15*e* Baseplate
16 Abutting plate
17 Elastic cylinder
18 Shield

The invention claimed is:

1. An inner glass skin structure for double glass skin, the inner glass skin structure being arranged inside a glass curtain wall with a predetermined spacing therefrom using the glass curtain wall as an outer glass, the inner glass skin structure comprising:

a plurality of sashless plate glasses arrayed in a sliding door formation to be placed inside the outer glass with the predetermined spacing therefrom facing against the outer glass, each edge of four sides of each said sashless plate glass being covered with an aluminum covering material;

a door roller fixed on a bottom of each said plate glass, on at least one of (a) an indoor side, (b) an outdoor side, and (c) both (a) and (b), among the plurality of sashless plate glasses in the sliding door formation intervening the aluminum covering material therebetween, the indoor side being a place opposite of the glass curtain wall with respect to the sliding door formation and the outdoor side is a place on the glass curtain wall side with respect to the sliding door formation;

a securing foot member fixed on the bottom of each said plate glass, intervening the aluminum covering material therebetween, to which the door roller is not fixed;

a lower rail member arranged on a floor underneath the plurality of sashless plate glasses the lower rail member being supporting movably on the bottom of each said plate glass for the inner glass intervening the door roller or being supporting fixedly on the bottom of each said plate glass for the inner glass intervening the securing foot member therebetween;

an upper rail member arranged on a ceiling directly above the plurality of sashless plate glasses configuring a pair of said plate glass with the lower rail member, the upper rail member supporting the plate glass pair at a respective top movably or immovably, wherein the aluminum covering material of each of said plate glasses having an approximate U-shape in cross-section comprises an end face cover part that covers an end face of a respective said edge of each said plate glass, an inner face cover part that covers an indoor-side-facing surface on a periphery of the respective edge of a corresponding said plate glass, and an outer face cover part that covers an outdoor-side-facing surface on the periphery of the respective edge of the corresponding plate glass;

the covering material for covering the top and bottom of each said plate glass is fixed on the respective edge of the corresponding plate glass through a bonding of an inside face of the end face cover part to an elastic intervening piece secured on the end face of the corresponding plate glass;

the covering material that covers both lateral sides of the corresponding plate glass is provided with a coupling plate retaining section formed inside the end face cover part thereof, the coupling plate retaining section accommodating a plurality of coupling strip plates arranged therein along the inner face thereof in a series formation with a predetermined regular mutual spacing retaining only both lateral sides of each coupling strip plate to permit free movement thereof along a longitudinal direction of the end face cover part; and the plurality of coupling strip plates arranged in the coupling plate retaining section are fixed on the end face of the corresponding plate glass by bonding the plurality of coupling strip plates to the elastic intervening piece secured on the end face of the corresponding plate glass and thereby the coupling strip plates in the coupling plate retaining section are secured on the end face of the corresponding plate glass.

2. The inner glass skin structure for double glass skin according to claim 1, wherein the covering material that covers both the lateral sides of the corresponding plate glass is provided with a reinforcing strip plate insertion slot that is formed along the longitudinal direction of the end face cover part on an outside thereof, the reinforcing strip plate being inserted therein.

3. The inner glass skin structure for double glass skin according to claim 1, wherein an elastic member is provided on each lateral side of each of the plate glasses as bumps against a door-hitting portion, and such said plate glasses are positioned on both ends of the sliding door formation as the inner glass skin configured to absorb a certain range of movement of each said plate glass that tends to move toward the door-hitting portion along a direction guided by the upper or lower rail member when an earthquake occurs.

* * * * *